US006013884A

United States Patent [19]

Rudolph et al.

[11] Patent Number: 6,013,884

[45] Date of Patent: Jan. 11, 2000

[54] MANUALLY ACTUATED ELECTRICAL SWITCH

[75] Inventors: Gerd Rudolph, Aspisheim; Erhard Lange, Obermoschel, both of Germany

[73] Assignee: Eaton Corporation, Cleveland, Ohio

[21] Appl. No.: 09/103,082

[22] Filed: Jun. 23, 1998

[30] Foreign Application Priority Data

Jun. 23, 1997 [DE] Germany ..... 197 26 529

[51] Int. Cl.[7] ..... H01H 23/30

[52] U.S. Cl. ..... 200/295; 200/339

[58] Field of Search ..... 200/295, 339, 200/315

[56] References Cited

U.S. PATENT DOCUMENTS 3,476,902 11/1969 Baldwin et al. ..... 200/295
4,051,916 10/1977 Oda ..... 200/295 X
4,135,073 1/1979 Kobayashi ..... 200/315
4,804,828 2/1989 Oogita ..... 200/295 X
5,118,912 6/1992 Itabashi ..... 200/295 X
5,561,279 10/1996 Hattori et al. ..... 200/339 X

*Primary Examiner*—Renee S. Luebke
*Attorney, Agent, or Firm*—Roger A. Johnston

[57] ABSTRACT

An electrical, manually actuated switch comprises a housing (11), in which a contact unit (27) is located that comprises switch elements (26), and at least one self-returning and eccentrically mounted switch (10) having a switch tappet (29) that acts on the switch elements (26). The manually actuated switch (9) is to be adapted to prevent a damaging or destruction of the switch elements (26) even under excessive loading. To achieve this object, the contact unit (27) is resiliently or spring mounted in a housing (11) and yields to excessive application of force to the switch elements (26) by the switch tappet (29), wherein a spring unit (60) is located between the contact unit (27) and the base (20) of the housing (11).

1 Claim, 4 Drawing Sheets

MANUALLY ACTUATED ELECTRICAL SWITCH

CROSS-REFERENCE TO RELATED APPLICATIONS

Not Applicable.

STATEMENT REGARDING FEDERALLY SPONSORED RESEARCH OR DEVELOPMENT

Not Applicable.

MICROFICHE APPENDIX

Not Applicable.

BACKGROUND OF THE INVENTION

The invention relates to an electrical, manually actuated switch with a housing, in which a contact unit comprising switch elements is located, and at least one self-returning and eccentrically mounted switch with a switch tappet (switch peg) that acts on the switch elements.

An electrical, manually actuated switch of this type is known from DE 195 11 878 A1. This is equipped with a housing that accepts switch elements and several self-returning and eccentrically mounted switches, each of which has a switch tappet that acts on the switch elements. Each switch comprises an actuating bulge that is provided with two juxtaposed deposed actuating surfaces, said actuating bulge being oriented approximately parallel to the axis of the switch mount (bearing). The actuating force initiated on the side of the switch mount approximately parallel to the housing has the same direction of effect on the switch as the actuating force initiated on the opposite side approximately perpendicular to the housing. The housing of the electrical, manually actuated switch is fixedly connected with the steering wheel of a motorized vehicle, wherein the actuating surfaces of the switches project through a hole in the cover, i.e. a hole in the steering wheel housing (container, basin), surrounding the steering wheel hub Such an electrical, manually actuated switch is particularly suited for triggering (initiating) switching functions, for example for temporary speed control (cruise control) of the motor vehicle and/or for controlling operation or functions of a radio/cassette unit located in the vehicle. A circuit board in the form of a contact unit is located in the housing in conjunction with a spring unit fastened on the housing. Via actuation of a switch, the switch tappet acts on the spring unit and connects or interrupts current paths on the circuit board. The circuit board itself is rigidly fastened in the inner space of the housing. Frequently, such circuit boards are provided with switch elements, in particular with micro-switches, by which the switching or operational functions are triggered. Such micro-switches are cost-efficient to manufacture and simple to operate. Nonetheless, they are disadvantageous in that they oftentimes are destroyed or damaged when subject to an overload, namely through actuation of the corresponding switch, whence the electrical, manually actuated switch becomes unusable.

BRIEF SUMMARY OF THE INVENTION

It is an object of the invention to provide an electrical, manually actuated switch of the aforementioned type in which damage or destruction of the switch elements is prevented even in the case of larger loads or an over-depression (over-stroke) of the actuating element.

In accordance with the invention, this object is achieved in that the contact unit is spring mounted in the housing and yields to excessive applications of force by the switch tappet on the switch elements. Preferably, a spring unit is located between the contact unit and the base (socket) of the housing. Thus, the switch elements are reliably operated by exertion of a force on the switches of the electrical, manually actuated switch, but are nonetheless protected from overload. An elastic over-stroke (over-depression) is achieved by the spring (resilient) mounting of the contacting unit in the housing, and suffices to resist an increased pressure on the switch. The switch elements on the contact unit provided for use of the electrical, manually actuated switch in accordance with regulations comprise a particular over-switching strength (resiliency), i.e. a resistive force, against the effects of pressure. When the switch element is actuated through application of a force on the corresponding switch, same acts on the switch element until its end stop (limit position) is reached. When a greater pressure is exerted on the switch, the switch element is typically destroyed or at least damaged. A spring unit that is formed as a leaf spring is formed along the housing built in between the contact unit and the base (socket) of the housing, and can accept the excessive exerted force. During such an application of force, the pressing together of the leaf spring is initiated, and the overload of the actuated switch is absorbed (counterbalanced), such that only a portion of the force acts on the corresponding switch element. The switch element is thus effectively protected against the excessive application of force.

In a preferred embodiment of the invention, the contact unit is held against the base (socket) of the housing with room for play by means of a clamping (wedging) element formed on the housing. Although the contact unit is thus fixed in its position in the housing, it can be moved in the direction of the housing base (housing socket) against the resistance of the spring unit when the switch is actuated with a given over-stroke (i.e., is over-depressed).

Preferably, the contact unit is formed as a circuit board, whereas the switching elements of the contact unit are micro-switches, connecting bridges or the like. Micro-switches are particularly suitable due to their high operational reliability, simplicity and cost-effective manufacturability.

In a preferred embodiment, the switch and the base (socket) of the housing are connected with one another via the switch mounting (switch bearing) and, via at least one clipping apparatus comprising (that provides) room for play. The switch mount (bearing) effects the pivotability (swivelability) of the switch around the given axis, whereas the clipping apparatus limits the swiveling (pivoting) motion of the switch to a predetermined range.

In order to effect the self-returning of the switch after its actuation, same is spring-loaded against the contact unit. Preferably, the switch comprises, in its hollow space, a peg that is loaded by a compression spring (pressure spring) and that projects from the inner wall of the housing perpendicular to the contact unit. The peg effects the return of the switch. When the switch is released, the compression spring located on the peg is relieved (expands) and presses the switch back to its starting position.

In accordance with a further embodiment of the invention, the switch comprises an actuating bulge that is provided with two juxtaposed actuating surfaces, the bulge being oriented essentially parallel to the axis of the switch mount (bearing). In this configuration, the actuating force exerted on the side of the switch mount (bearing) approximately parallel to the housing has the same direction of effect on the switch as the actuating force exerted on the opposite (juxtaposed) side approximately perpendicular to the housing. Ease of operation is thus achieved that allows the electrical, manually actuated switch to be actuated in various directions. Thus, no complicated (force) re-directing mechanism is necessary in order to adapt the direction of the actuating forces to the operational direction of the switch, resulting in a particularly cost-effective arrangement.

In a preferred embodiment of the invention, the manually actuated switch is mounted in the region of a steering wheel of a motorized vehicle such that a hand that is gripping the rim of the steering wheel can act upon the one actuating surface with its thumb and on the other actuating surface of the switch with a finger. The hand can remain supported on the rim of the steering wheel while gripping the steering wheel. It is thus very simple to correctly apply the required actuating force. The actuating force is introduced (applied) analogous with natural movement of the fingers or of the thumb, wherein the grip on the rim of the steering wheel does not need to be loosened during the actuation of the manually actuated switch. Indeed, a tighter closing around the rim of the steering wheel results from the finger and thumb carrying out the actuation.

In order to be easily accessible with regard to the orientation of the joints of the fingers and the thumb, the manually actuated switch in accordance with a preferred embodiment of such a switch is located relative to the rim of the steering wheel such that the actuating bulge of the switch runs behind the rim of the steering wheel nearly parallel and set back along the rim of the steering wheel. This ensures an optimal configuration of the switch for actuation by the fingers and thumb.

In a further embodiment of the invention, the housing is fixedly connected to the steering wheel, wherein the actuating surfaces of the switch project through a hole in the cover, i.e. in a housing (container, basin), surrounding the hub of the steering wheel in the region of the switch where no steering wheel spokes are provided. During actuation of the manually actuated switch, the fingers and the thumb always lie opposite one another relative to the operating surfaces. If the steering wheel is turned, the switch also turns at the same angle. Actuation of the switch is thus possible even in critical situations without taking the hand from the steering wheel. Furthermore, an unobstructed view of the switch is always ensured.

Preferably, the actuating surface of the switch facing the operator possesses a symbol surface that is illuminated via an illumination element located underneath the switch. Particularly at night and also in the phase in which the operator must accustom himself to a switch configuration, or an operator inexperienced with the configuration has the steering, wheel in his hand, incorrect operation is excluded through the indication and illumination of the symbol surface for the switch functions.

In order to steer (guide) the entire intensity of light onto the symbol surface of the switch and to mask its surroundings from the light acting thereon, the switch comprises, in its hollow space along the inner wall of its housing, a light guide channel oriented from the illumination element of the contact unit to the symbol surface. The light guide channel is of such a length that it bumps against the base (socket) of the housing with its front end when excessive force is applied. Preferably, the manually actuated switch mounted on the steering wheel further comprises at least three switches (buttons) located next to one another. Several switching functions can thus be implemented on one electrical, manually actuated switch.

Furthermore, the central or the outer switches have sealing flanges (collars) on their respective side walls facing on another that bridge the gap between neighboring switches. The sealing flanges prevent the penetration of dirt into the manually actuated switch. Furthermore, the undesired radiation of light is avoided that is emitted from the illuminating element present in the housing.

The switch mount (bearing) for each switch preferably comprises at least one mounting (bearing) tab that is fixed to the housing and that has bearing pegs (trunnions, journals) and one opening in the side wall of the switch corresponding thereto. In an alternative embodiment, however, the switch mount for each switch comprises at least one mounting (bearing) tab fixed to the housing and one bearing peg (trunnion, journal) formed along the side wall of the switch, with the trunnion engaging a corresponding opening in the bearing tab.

In order to exploit the available space along the rim of the steering wheel particularly between two steering spokes and in order to be able to implement as many switch functions as possible, two diametrically opposed, manually actuated switches are located in the region of the steering wheel of the motorized vehicle. The switches of the manually actuated switch and the switch elements of the contact unit can thus be provided with various switch functions. It is thus possible to provide the switches of each manually actuated switch and the switch elements of the contact unit with switch functions for controlling a radio and/or cassette player and/or CD player and/or CD changer (juke box) located in the motorized vehicle.

BRIEF DESCRIPTION OF THE DRAWINGS

FIG. 8 is a plan view of the electrical, manually actuated switch in the direction of arrow VIII of FIG. 4, FIG. 9 is a view of the electrical, manually actuated switch in the direction of arrow IX of FIG. 4.

DETAILED DESCRIPTION OF THE INVENTION

Figure 1:
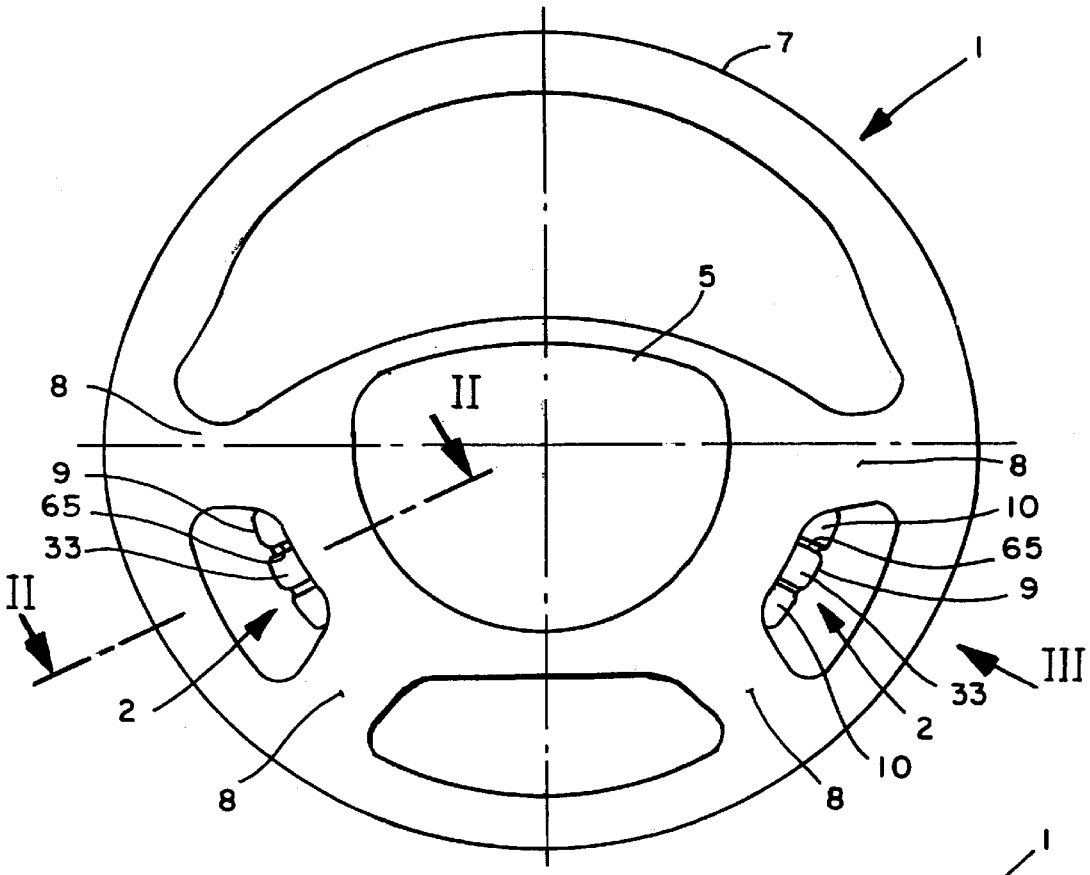
FIG. 1 is a view onto the steering wheel of a motor vehicle with electrical, manually operated switches in accordance with the invention.
Figure 2:
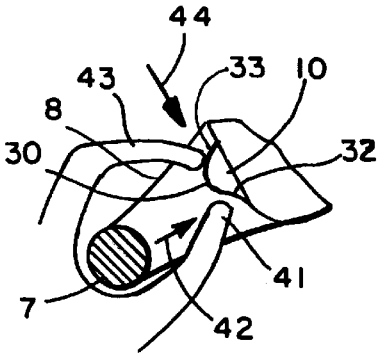
FIG. 2 is a cross-section through the steering wheel in accordance with FIG. 1 along the line II—II.
Figure 3:
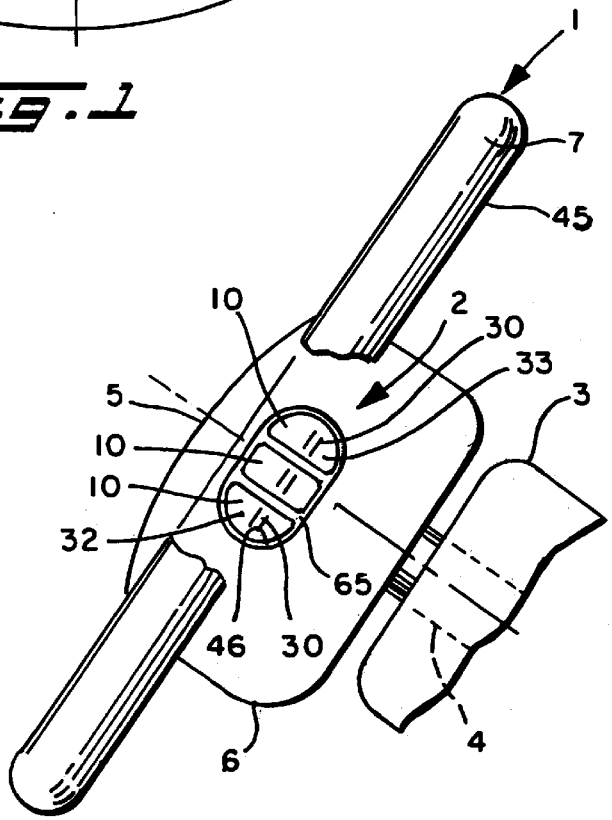
FIG. 3 is a view onto the steering wheel of FIG. 1 in the direction of arrow III with part of the steering wheel rim cut away.

In FIGS. 1 to 3, a steering wheel indicated generally at 1 is illustrated in conjunction with a switch unit indicated generally at 2. The steering box 3, in which the steering column 4 is mounted, on whose end the steering wheel 1 is located, lies behind the steering wheel 1. The steering wheel hub 5 that surrounds the steering wheel housing (case, basin)

is located concentric to the steering wheel 1. A steering wheel housing 6 houses the air bag, the horn contact and an electrical connecting system, via which the contact from the rotating steer wheel 1 to the fixed steering box 3 is transmitted. The steering wheel 1 comprises a steering wheel rim 7 that is connected via steering wheel spokes 8 to the steering wheel housing 6 surrounding the steering wheel hub axis 5. A switch unit 2 that is located in the steering wheel housing 6 consists of two manually actuated switches 9, one of which is located on each side of the steering wheel 1. Each of the manually actuated switches 9 comprises three switches (buttons) 10 that are configured next to one another and are visible to the operator.

Figure 4:
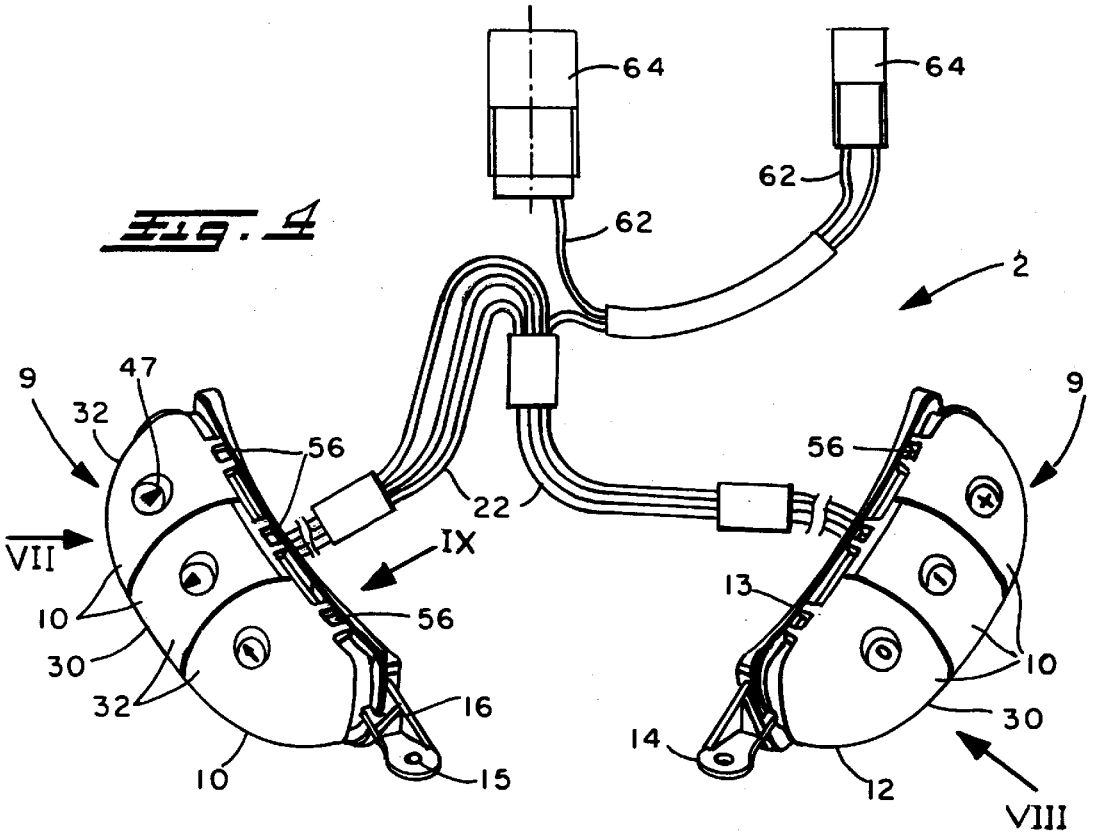
FIG. 4 is a perspective view onto a switch unit put together of electrical, manually actuated switches in accordance with the invention.
Figure 5:
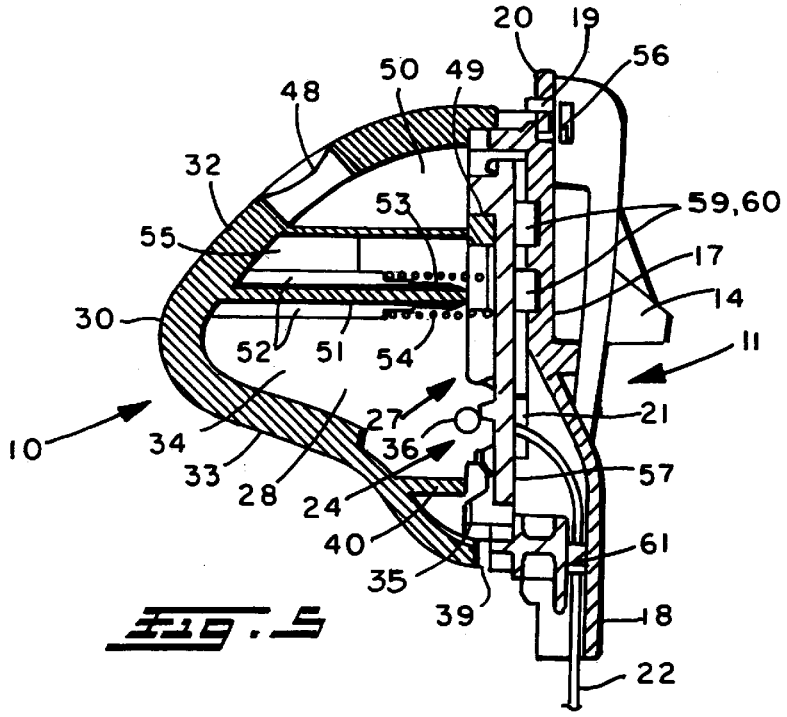
FIG. 5 is a cross-section through an unactuated, electrical, manually actuated switch along line V—V of FIG. 7.
Figure 5:
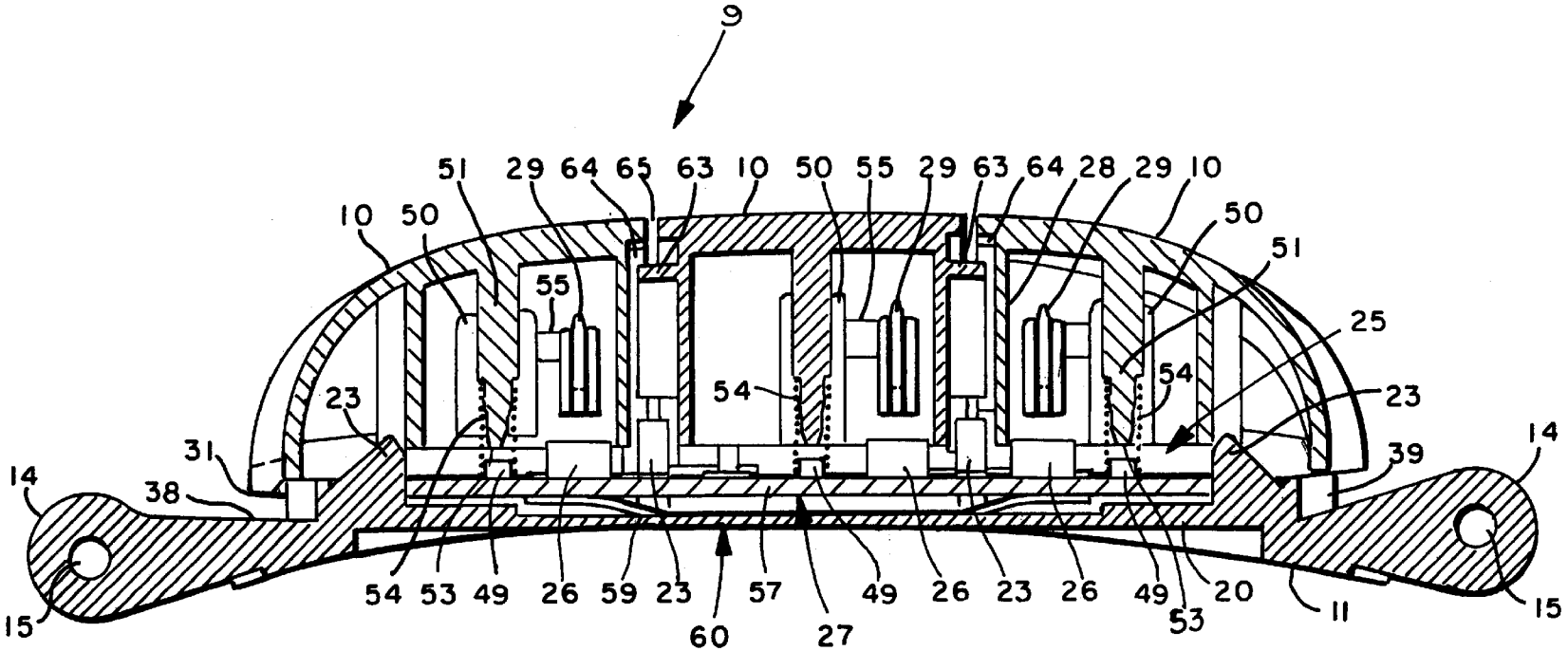
Figure 6:
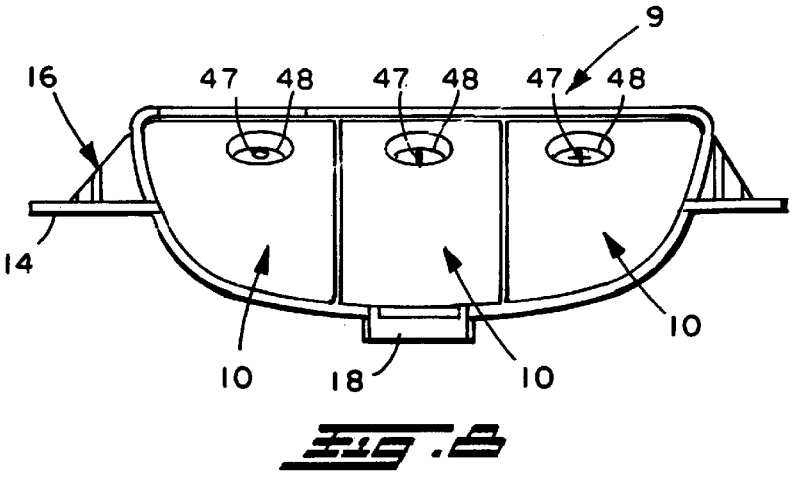
FIG. 6 is a cross-section through the electrical, manually actuated switch along line VI—VI of FIG. 10.

Referring to FIGS. 4, 5 and 6 the manually actuated switch indicated generally at 9 comprises a roughly rectangular housing indicated generally at 11 with narrow sides 12 and longitudinal sides 13. On oppositely disposed ends of the housing indicated generally at 11, a mounting (fastening) flange 14 with a built-in mounting (fastening) hole 15 is formed between a respective narrow side 12 and a respective longitudinal side 13. For stiffening the mounting flange 14, a brace (strut) 16 is located between mounting flange 14 and the narrow side 12. The housing 11 is made wider at its base 17 than the switches 10. Furthermore, a connecting portion 18 is formed on the housing wall 19 and continues as a base (socket) 20. The base (socket) 20 does not cover the entire opening at the base 17 of the housing 11. Electrical wires 22 lead through an empty space 21 to the connecting portion 18. Two mounting (bearing) tabs 23 for each switch 10 are injection-molded on the base (socket) 20. The bearing tabs 23 form switch mounts indicated generally at 24 that lie eccentric (not centered) with respect to the housing 11. The two bearing tabs 23 (FIG. 9) present for a switch 10 are spaced far enough from one another that they can also guide the switch 10 axially. Switch elements 26 that are provided both for the electrical and also for the mechanical switching are located on the inner side 25 of the base 20. The switch elements 26 formed as micro-switches are located on a contact unit 27. The switch (button) 10 comprises a hollow space on the side facing the housing 11, through which hollow space a switch tappet (peg) 29 injection-molded on a switch wall 28 projects.

Each switch 10 comprises an actuating bulge 30 that is oriented nearly parallel to the axis of the switch mount 24 that is spaced from same. The surfaces running on both sides from the edge of the switch 31 to the actuating bulge 30 are the actuating surfaces 32 and 33. The actuating surfaces 32 and 33 run, like the actuating bulge 30, nearly parallel to the axis of the switch mount 24. Switch shanks 34 project outwardly from the circumferential edge of the switch 31, perpendicular to the switch mount 24 and perpendicular to the actuating surfaces 32 and 33. A bearing or mounting flange 35 in which a flange bore 36 is created connects to each switch shank 34. A bearing peg (trunnion, journal) 37 mounted on the bearing or mounting tab 23 projects into the flange bore 36. A gap 39 is located between the edge of the switch 31 and the upper side of the housing 38. The bearing tab 23 fixed to the housing is made high enough that the switch mount 24 is located approximately at the same height as the gap 39. In the direct vicinity thereof, a reinforcement wall (buttress) 40 is formed in the inner space of the switch 10.

The manually actuated switch 9 is mounted on the steering wheel 1 such that the actuating force 42 initiated by the thumb 41 acts on the actuating surface 32 opposite the switch mount 24 such that it is nearly perpendicular to the housing 11. The actuating force 44 initiated by the fingers 43 acts on the actuating surface 33 that is located on the side of the switch mount 24 that extends from the edge of the switch 31 to the actuating bulge 30. The boundaries (the extension) of the actuating surface 32 go from the edge of the switch 31 to the actuating bulge 30 opposite the actuating surface 33. The configuration of the actuating surfaces 32 and 33 and the actuating bulge 30 located therebetween is roughly V-shaped, although the actuating bulge 30 is located eccentrically on the switch 10 more in the direction of the switch mount 24.

The housing 11 of the manually actuated switch 9 is mounted via the mounting flange 14 in the region of the steering wheel 1. The mounting or fastening is carried out such that the hand gripping the rim of the steering wheel 7 lies in front of the actuating surface 33 with its fingers 43 and in front of the actuating surface 32 with its thumb 41, whence the actuating force 42 and/or 44 can be initiated. The most favorable configuration is when the actuating bulge 30 lies nearly parallel to the rim of the steering wheel 7 at the height of or coincident with the back side 45 of the rim of the steering wheel 7. It will be understood that the back side 45 of the rim of the steering wheel 7 is the side of the steering wheel 1 that faces away from the operator.

The housing 11 is fixedly connected to the steering wheel 1. The manually actuated switch 9 thus turns along with the steering wheel 1. The steering wheel 1 is surrounded in the region of its steering wheel hub 5 by steering wheel housing (casing, basin) 6 that also turns along with the steering wheel 1. A cover hole 46 is made in the steering wheel housing or casing 6 that is just large enough for the switches or buttons 10 of the manually actuated switch 9 to protrude through at that location with their actuating surfaces 32 and 33 and their actuating bulge 30 and for them to be able to move freely. The steering wheel housing 6 also covers the region of the housing 11 and the mounting flanges 14 located thereon to protrude beyond the switches (buttons) 10. The fastening of the manually actuated switch 9 to the steering wheel 1 is always carried out at a position where no steering wheel spokes 8 lie in front of the switches (buttons) 10 of the manually actuated switch 9.

Figure 7:
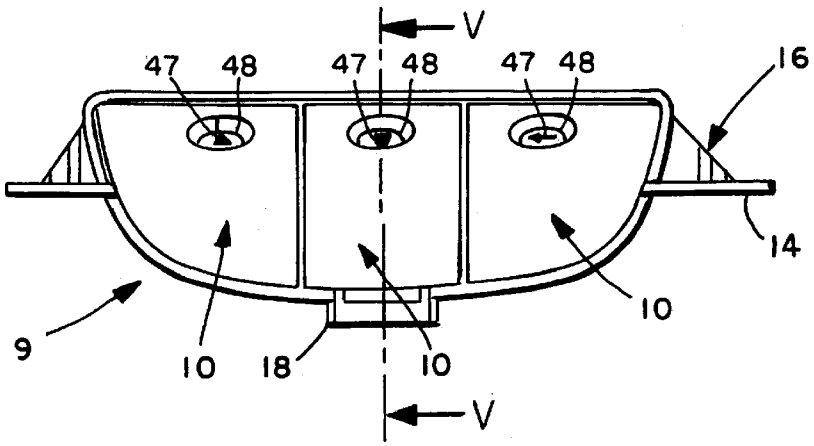
FIG. 7 is a plan view of the electrical, manually actuated switch in the direction of arrow VII of FIG. 4.
Figure 5:
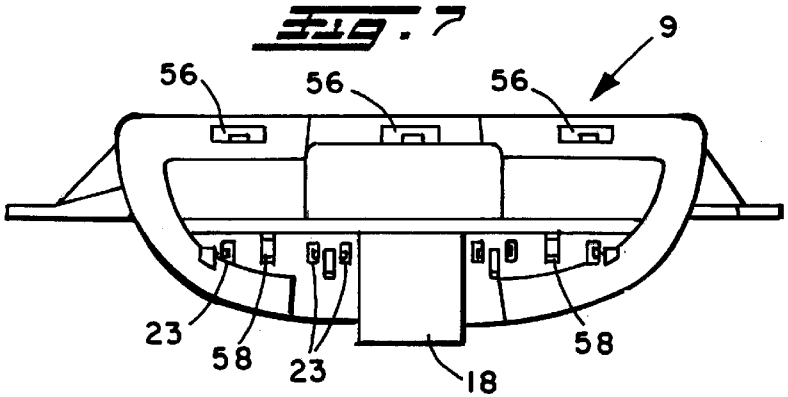

As can be seen from FIG. 1, the steering wheel 1 comprises a total of four steering wheel spokes 8. The distance between two steering wheel spokes 8 is designed such that the switches 10 protrude directly between the two steering wheel spokes 8. The operator thus has a clear view of the switches 10, i.e. of the actuating surfaces 32. A symbol 47 is applied to each of the actuating surfaces 32 that gives an indication of the function of the corresponding switch (button) 10. A translucent symbol surface 48 is embedded in the actuating surface 32 of the switch 10, as is shown in FIGS. 7 and 8 so that the operator obtains an indication of the function of the switch 10 even in the dark. As is particularly visible in FIGS. 7 and 8, each symbol 47 corresponds to a particular function. In the exemplary embodiment, these functions relate to a radio/cassette unit, i.e. for instance, station/track search functions in accordance with manually actuated switch 9 of FIG. 7 or volume switching functions in accordance with manually actuated switch 9 of FIG. 8. In accordance with FIG. 5, an illuminating element 49 in the form of an LED is mounted on the contact unit 27 on the inside of the manually actuated switch 9. If the illuminating element 49 is actuated, the light also radiates through the symbol surface 48 and the switch 10. In the unilluminated condition of the switch 10, recognition of the switch function is enabled through tactile symbols (not illustrated) applied to the actuating surfaces 32 and 33. The light guide channel 50 in the form of a tube with a square cross-section is formed in the inside of the switch 10 through which the light radiated from the illuminated element 49 is guided to the symbol surface 48 on the actuating surface 33 of the switch 10.

A peg 51 protrudes or extends from the inner wall of the housing, roughly in the transition region from the actuating bulge 30 to the actuating surface 32, perpendicular to the contact unit 27 and is spaced away from the light guide channel 50. This peg 51 is located approximately in the middle of the hollow space of the switch 10. This peg 51 is provided circumferentially with stiffeners (reinforcements) 52 that extend nearly over its entire length. The free end 53 of the peg 51 is surrounded by compression spring 54 that is supported by the stiffeners 52 and by the upper side of the contact unit 27. A web or cross-piece 55 that is connected with the switch tappet 29 is formed on the peg 51 in accordance with FIG. 6. The switch tappet (switch peg) 29 is thus held such that its position is stabilized.

Referring to FIG. 4 clip connections 56 are formed on the base (socket) 20 of the housing 11 and on each of the switches (buttons) 10 in correspondence thereto, such that they are opposite the side on which the switch mounts 24 are located. The clip connection 56 has enough play that the switch 10 can be actuated about the switch mount 24.

Figure 10:
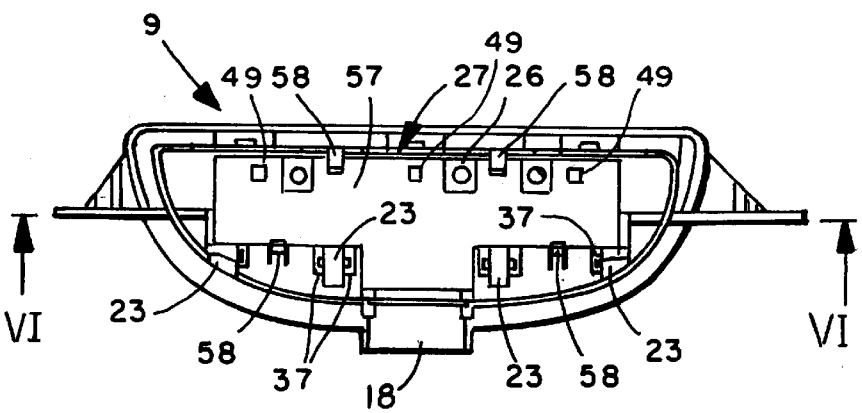
FIG. 10 is a view onto the electrical, manually actuated switch without illustration of the switches (buttons).

A circuit board 57 is located on the base 20 of the housing 11 as a contact unit 27. The circuit board 57 is movably held (FIG. 10) via several clamping or wedging elements 58 formed as a single piece with the housing 11 and distributed along its circumference. A spring unit 60 formed as a leaf spring 59 is located between the underside of the circuit board 57 and the upper side of the base 20 of the housing 11.

Through exertion of an actuating force 42 or 44 via the thumb 51 or the fingers 43 on the actuating surfaces 32 and/or 33 of the switch 10, the switch tappet 29 presses on the switch element 26 that is formed as a micro-switch located on the circuit board 57. If a larger force is exerted thereby, the circuit board 57 is further pressed against the spring force of the leaf spring 59 and is thus yielding within the limits of the clamping or wedging elements 58. Various switch functions are triggered thereby via the micro-switches. Electrical impulses are transmitted via the wires (lines) 22 that are fastened in the connector 18 of the housing 11 by means of a clip (clamp) 61 and via further connection wires 62 and connection plugs or sockets 64 attached thereto to the unshown on-board network (on-board circuitry) of the motorized vehicle.

When the switch 10 is released, the relieving of the leaf spring 59 effects a relieving of (lessening of the load on) the circuit board 57 that thus returns to its starting position. Simultaneously, the circuit board 57 exerts a pressure on the compression spring 54, whence same presses back the corresponding peg 51 and thus dictates that the switch 10 be moved back into its starting position. A sealing flange (collar) 63 is formed to the side of the middle switch in accordance with FIG. 6 along its switch wall 28; and, the said sealing flange projects into a corresponding recess (cutout) 64 of the adjacent, outer switches 10. A gap 65 is formed between the adjacent switches 10 in order to avoid a rubbing together of the adjacent switches 10. The gap 65 is covered by the flange 63 along the middle switch such that no dirt can get into the inner portion of the manually actuated switch 9 and that light created by the illuminating element 49 cannot escape.

Although the invention has hereinabove been described with respect to the illustrated embodiments, it will be understood that the invention is capable of modification and variation and is limited only by the following claims.

We claim:

1. A manually actuated electrical switch assembly comprising:

(a) a housing;

(b) a contact unit having a plurality of switch elements thereon wherein said contact unit is retained for movement in said housing by wedging elements formed in said housing;

(c) an actuator disposed on said housing for user movement from an unactuating to an actuating position;

(d) a plurality of tappet members slidably disposed on said housing and each operative upon said user movement of said actuator to transmit an actuating movement to one of said switch elements;

(e) a spring element disposed between said contact unit and said housing and operative to absorb over-travel of said actuating movement after actuation of said switch element; and, (f) means for returning said actuator to the unactuating position.

* * * * *